US007507909B2

(12) United States Patent
Federighi et al.

(10) Patent No.: US 7,507,909 B2
(45) Date of Patent: Mar. 24, 2009

(54) CABLE COMPRISING TWISTED METALLIC CONDUCTORS WITH HIGH ELECTRICAL PERFORMANCE FOR USE IN DIGITAL SYSTEMS

(75) Inventors: Renata Cidade Federighi, Sorocaba (BR); João Carlos Vieira Da Silva, Sorocaba (BR); Marcelo de Araújo Andrade, Sorocaba (BR)

(73) Assignee: Prysmian Telecomunicacoes Cabos E Sistemas Do Brasil S.A., Sorocaba, Sao Paulo (BR)

( * ) Notice: Subject to any disclaimer, the term of this patent is extended or adjusted under 35 U.S.C. 154(b) by 0 days.

(21) Appl. No.: 10/507,744

(22) PCT Filed: Mar. 14, 2003

(86) PCT No.: PCT/BR03/00037

§ 371 (c)(1),
(2), (4) Date: Apr. 13, 2005

(87) PCT Pub. No.: WO03/079377

PCT Pub. Date: Sep. 25, 2003

(65) Prior Publication Data

US 2005/0173144 A1 Aug. 11, 2005

(30) Foreign Application Priority Data

Mar. 18, 2002 (BR) ..... 0200850

(51) Int. Cl.
*H01B 7/00* (2006.01)

(52) U.S. Cl. ..... 174/113 R; 174/27

(58) Field of Classification Search ..... 174/110 R, 174/113 R, 34, 128.2

See application file for complete search history.

(56) References Cited

U.S. PATENT DOCUMENTS

| | | | | |
|---|---|---|---|---|
| 3,546,357 | A * | 12/1970 | Windeler et al. | 174/34 |
| 4,697,051 | A | 9/1987 | Beggs et al. | |
| 5,763,823 | A | 6/1998 | Siekierka et al. | |
| RE37,010 | E * | 1/2001 | Newmoyer | 174/113 R |
| 6,333,465 | B1 | 12/2001 | Prudhon | |

FOREIGN PATENT DOCUMENTS

| | | |
|---|---|---|
| JP | H6-349344 | 6/1993 |
| JP | 6-349344 | * 12/1994 |

OTHER PUBLICATIONS

Abstract and Translation of JP 6-349344.*
Masahiro; "Interface Cable"; Patent Abstracts of Japan, of JP 11-111078, Apr. 23, 1999.

* cited by examiner

*Primary Examiner*—William H Mayo, III
(74) *Attorney, Agent, or Firm*—Finnegan, Henderson, Farabow, Garrett & Dunner, LLP

(57) ABSTRACT

A cable having twisted metallic conductors for use in digital systems. Twisted metallic conductor cable with high electrical performance for use in digital systems formed by a bundled array of insulated metallic conductors of thermoplastic material sheathed in a protective banding and by a metallic shielding and finally by a protective cover. The cable uses simultaneously a series of pitches having a maximum and minimum value between 10 and 80 mm and a conductor insulation with a thickness from 2.0 to 2.2 times the conductor diameter for a dielectric constant of 1.87. The combination of the special sequence of pitches and an adequate insulation thickness provides a decrease in attenuation and an improvement concerning the problem of cross talk in digital data transmission.

11 Claims, 5 Drawing Sheets

CABLE COMPRISING TWISTED METALLIC CONDUCTORS WITH HIGH ELECTRICAL PERFORMANCE FOR USE IN DIGITAL SYSTEMS

CROSS REFERENCE TO RELATED APPLICATION

This application is a national phase application based on PCT/BR03/00037, filed Mar. 14, 2003, the content of which is incorporated herein by reference and claims the priority of Brazilian Application No. PI0200850-5, filed Mar. 18, 2002.

BACKGROUND OF THE INVENTION

1. Field of the Invention

The present invention refers to a copper pair cable, evidencing high performance when used in digital systems of the DSL (Digital Subscriber Line) type.

2. Description of the Related Art

In the past, copper pair cables were used solely for traffic consisting in voice analogical electrical signals. However, with the appearance of the Internet, those same copper cables have been used for data traffic. With the increasing demand for data traffic, and increasingly higher data rates, there came into existence the digital subscriber line (DSL), which further increases the data rate to be supported by the old copper pair cable network.

That technology makes use of digital signal processing, advanced algorithms, filters, analogical/digital converters, such as that in the ADSL (Asymmetric Digital Subscriber Line) type of transmission it is possible to reach rates up to 8 Mbps for downstream transmission and 640 Kbps for upstream transmission, thus rendering the ADSL technology particularly appealing for downloading Internet files.

However, in order that such transmission rates may be reached, it is necessary to relay the service through distances of at least 2 km, in ideal transmission conditions. There is also the problem of signal interference between the conductor pairs, known as cross talk. There is a recommendation widely used by the telephony service operators, whereby only 8 of every 25 conductor pairs of a cable may be used for traffic of a digital system, in order to avoid cross talk.

In order to solve these problems, there has been developed by means of the present invention a twisted conductor pair cable having improved electrical characteristics, whereby it is possible to reach across greater distances with the service, and also to use all the conductor pairs of a cable for digital transmission purposes.

Therefore, in order to solve the first basic problem, i.e., to allow an increase in the distance reached by the digital system, there has been made an option, according to the present invention, to reduce attenuation in the line without the need to alter the gauge of the metallic conductor. Any signal is subject to attenuation, i.e., loses power as it is carried along a line. The parameters that are responsible for this loss of power are the resistance of the conductors, the conductance (dielectric loss), the capacitance and the inductance.

Since attenuation is directly proportional to capacitance, in order to reduce attenuation in the line, the mutual capacitance of the conductor pairs was reduced, there being achieved thereby an attenuation reduced by 20% in average as compared to conventional cables, without the need to alter the diameter of the copper conductor. The reduction in capacitance was achieved by increasing the insulation thickness, since the distance between the conductors is inversely proportional to the mutual capacitance thereof.

However, in order to achieve the desired levels of mutual capacitance, using only the insulation provided by a solid sheath of polyethylene for the conductor, it would be necessary to excessively increase the diameter of the insulated conductor, that in turn would cause an increase of diameter and weight of the overall cable assembly, which would be inconvenient from both in terms of cost and in terms of installation. Although inconvenient, this solution using solid polyethylene is technically feasible. However, in order to avoid the problems incurred by increased weight and diameter, an option was made to use a combination of cellular and solid insulation.

The second basic problem in digital transmission is the maximum number of conductor pairs that simultaneously use the digital service within one same cable. An increasing number of conductor pairs carrying data will correspond to increasing cross talk.

Cross talk is the transfer of energy from a circuit (conductor pair) to another, causing loss of power of the signal being transmitted in the affected conductor pair.

In order to reduce the effect of cross talk, there are widely used twisted conductor pairs, since that when the conductor pairs are twisted with one another there occurs an effect of mutual cancellation of electromagnetic forces, causing a reduction in cross talk. Normally the conductor pairs of the cables are twisted with different pitches, a characteristic referred to as pitch series. This concept has been used for the present invention, although with a special pitch series, shorter than usual, with pitches distinct from one another, following a geometric progression, according to studies that were conducted and results that were achieved empirically.

The twisting pitches available for manufacture of the cable are those used in the running modes of the so-called twisting-cording machines. It is recommended to check each machine's kinematics system to know exactly which are the available pitches. As an example, there may be cited that in naming mode position 4-0 of the FME-3 machine, the pitches range from 71.4 mm to 197.7 mm, and the machine speed in this running mode is 95 meters per minute. If it were required to have a reduced series of pitches, there might be used, for example, running mode 1-0 of that same machine, with a minimum pitch of 26.9 mm and a maximum pitch of 74.5 mm and a machine speed of 35 meters per minute. The ratio between the two twisting pitches follows a geometric progression:

$$a_n = a_1 . q^{n-1}$$

There is not a satisfactory mathematical model for calculation of the impact of pitches upon cross talk, but it is known that shorter pitches provide better electrical performance, but however that leads to a reduction of the machine speed. It is necessary to perform a cost/benefit analysis when deciding on a pitch series.

SUMMARY OF THE INVENTION

In the present invention there has been used a pitch series following a geometric progression and with minimum and maximum pitch values preferably comprised between about 10 and 110 mm, more preferably between about 10 and 80 mm, and with a ratio of said geometric progression preferably comprised between 1 and 2, more preferably between about 1.01 and 1.09.

The present invention thus relates to a twisted metallic conductor cable with high electrical performance for use in digital systems comprising a bundled array of insulated metallic conductors of thermoplastic material and at least a protective layer surrounding said bundled array, wherein said conductors are twisted in pairs with a series of pitches following a geometrical progression.

Preferably, the pitches have a maximum and a minimum values comprised between 10 and 110 mm, more preferably between 10 and 80 mm. Preferably, the geometrical progression has a rate higher that 1 and lower than 2, more preferably between about 1.01 and 1.09. The "about" has to be interpreted as an uncertainty of ±3% due to the machinery.

Advantageously, the conductors are provided with corresponding insulations and the ratio between the diameter of the conductor and the thickness of the corresponding insulation is preferably comprised between 2.0 and 2.2. The insulation provides an equivalent dielectric constant comprised preferably between 1.7 and 2.

The insulation is preferably formed in two parts, of which one is an internal part made of a cellular thermoplastic material and the other part is an external part made of a rigid thermoplastic material. The cellular insulation may be made of cellular polyethylene with 20% or 40% expansion rate. The rigid insulation may be made of a material selected from solid high density, medium density or low density polyethylene, polypropylene or polyvinyl chloride (PVC).

The bundled array of conductors may be sheathed in a protective banding, then by a metallic shielding, and finally by a protective cover, all these elements being disposed concentrically.

The cable of the present invention is therefore characterized by a reduced cross-talk owing to the particular choice of the series of pitches used for twisting the conductor pairs. Moreover, a lower attenuation may be achieved by opportunely selecting the thickness of the insulation with respect to the diameter of the metal conductor.

The thickness of the double insulation may vary, ranging from what would amount to a very small thickness value (almost null) of one of these (cellular insulation or solid insulation) to a very large value of the other, including the possibility of very similar thickness values for both insulations. Nevertheless, in order that the result is satisfactory, it is necessary to shift the level of mutual capacitance that is used in prior art with a value of 51 nF. This mutual capacitance shift should be at least about 20% less, which causes, for example for a cable configuration of dry core having insulated conductors made of solid polyethylene, that is necessary to increase by about 30% the insulation thickness leading the mutual capacitance to about 40 nF/km. Lower mutual capacitance values may be used provided that the cost/benefit relationship for the design is evaluated.

The first layer is made of cellular polyethylene, since this material has a low dielectric constant (Er). Over the layer of cellular material there is applied a layer of solid polyethylene, with much higher dielectric constant. This combination of dielectric constants is advantageous since thereby the resulting constant is lower than the constant in the case of solid polyethylene insulation, and therefore the diameter of the insulated conductor will be smaller. This is due to the fact at the dielectric constant is directly proportional to the capacitance, thus the same capacitance may be achieved without resorting to an excessive increase in diameter of the insulated conductor.

Once the diameter of the conductor has been determined, there should be calculated which will be the diameter of the assembly comprising the conductor and its thermoplastic insulation, also referred to as the insulated wire. This diameter is directly dependent on the mutual capacitance that has to be achieved in the cable.

In one embodiment of the present invention, the conductor diameter used was 0.392 mm and the thickness of the cellular insulation used was 0.164 mm with a thickness of solid insulation of 0.03 mm, and an equivalent dielectric constant of 1.87 was achieved. With this configuration, the mean mutual capacitance achieved was 38.0 nF/km.

Upon there having been determined the diameter of the insulated wire, it may be necessary to calculate the coaxial capacitance, since some machines control the diameter of the insulated wire by means of the coaxial capacitance.

$$C_{coaxial} = 2\pi \cdot \frac{\varepsilon_0 \cdot \varepsilon_r}{\ln\frac{\phi v}{\phi c}} \cdot 10^{-2}$$

$C_{coaxial}$=Coaxial capacitance (pF/m)
$\epsilon_0$=vacuum permittivity ($8{,}854 \cdot 10^{-12}$ F/m)
$\epsilon_r$=Relative dielectric constant of the insulating material (according to Table 1)
$\phi v$=diameter of the insulated wire (mm)
$\phi c$=diameter of the conductor (mm)

BRIEF DESCRIPTION OF THE DRAWINGS

For a better understanding of the present invention, reference is made to the attached drawings, wherein:

FIG. 2 also shows an enlarged view of the twisted pairs of conductors included in the cable.

DETAILED DESCRIPTION OF THE INVENTION

Figure 1:
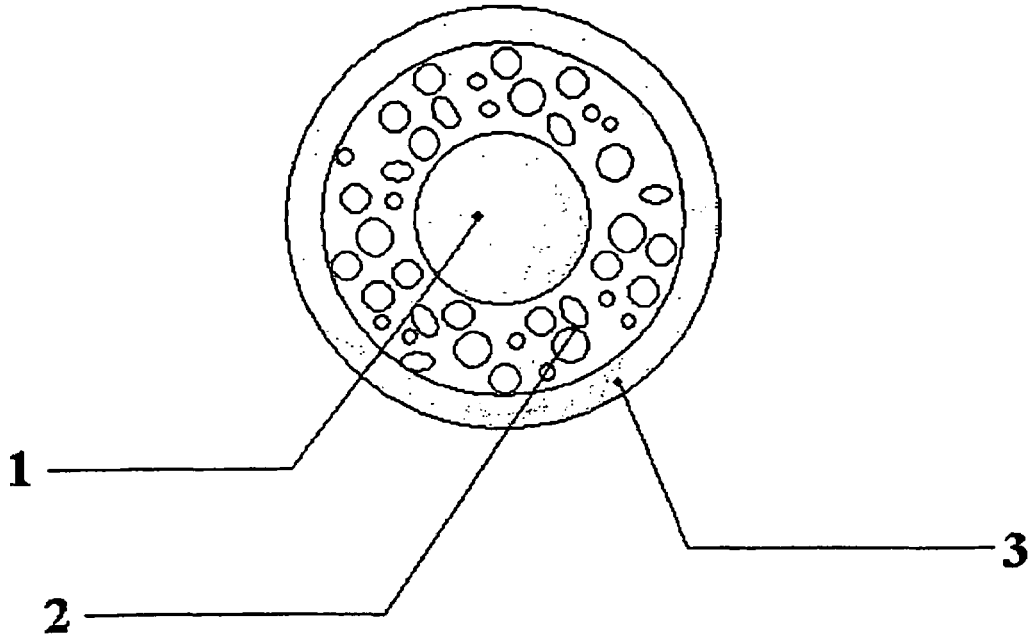
FIG. 1 is a cross-sectional view of a cable according to the invention comprising a conductor core surrounded by a cellular insulation and a solid insulation.

In FIG. 1 there is shown a cross-sectional view of a cable according to the invention, wherein a conductor core 1 (wire) is surrounded by an insulation 2 made of a cellular material (foam), sheathed in a solid insulation 3 (skin). The said cellular material is preferably cellular polyethylene, however not excluding other polymeric materials that may have a cellular state. The solid sheath is preferably made of solid polyethylene, having a higher dielectric constant. Also in this case, other polymeric materials may be used. The table I below illustrates examples of thermoplastic materials with their respective dielectric constants, that may be used in accordance with the present invention.

TABLE I

Dielectric constant of insulating materials

| Material | $\epsilon_r$ |
|---|---|
| Solid high-density polyethylene | 2.33 |
| Solid medium-density polyethylene | 2.32 |
| Solid low-density polyethylene | 2.28 |
| Cellular polyethylene, 20% expansion | 2.0 |
| Cellular polyethylene, 40% expansion | 1.7 |
| Polypropylene | 2.24 |
| Polyvinyl chloride (PVC) | 4 to 6.5 |

Figure 1A:
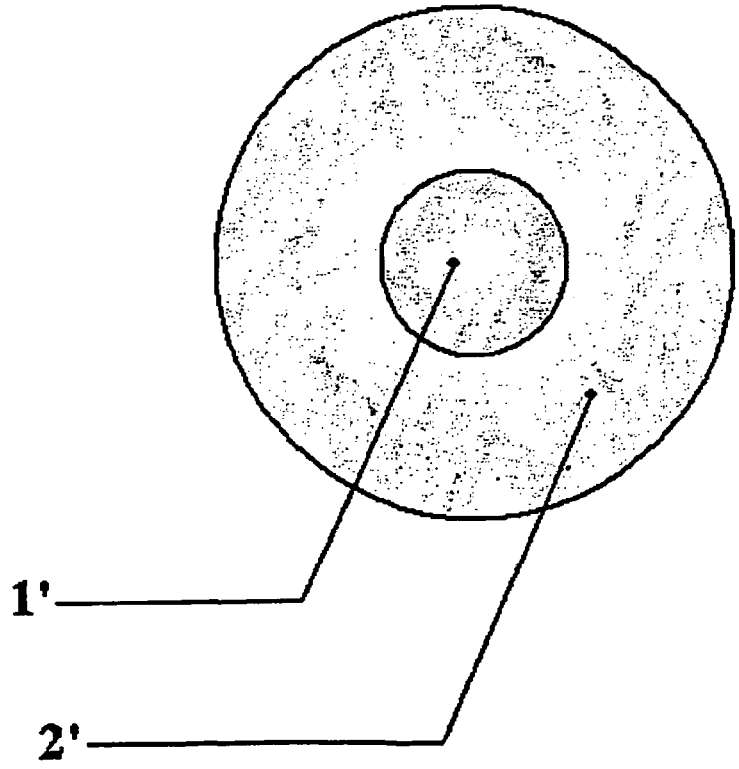
FIG. 1A depicts a cross-sectional view of an alternative cable according to the invention including the conductor core and solid insulation.

FIG. 1A shows a cable devoid of the cellular insulation, i.e., having a conductor core 1' with the pitch arrangement according to the invention and a solid sheath 2'.

Figure 2:
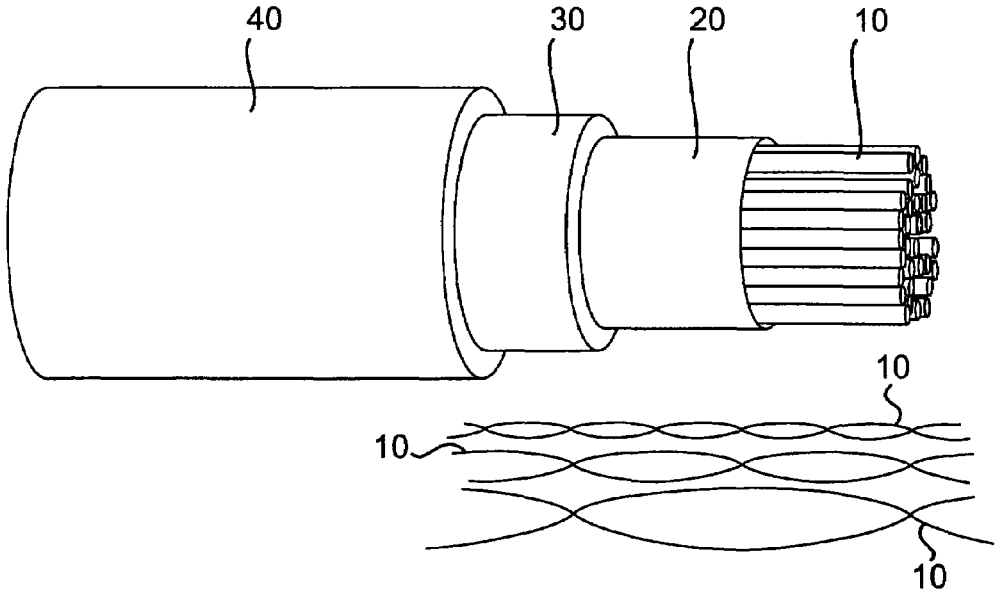
FIG. 2 shows a perspective view taken along the longitudinal direction of the cable, with some parts broken away to illustrate a cable produced according to the present invention.

FIG. 2 shows the assembly of the cable in the finished state where a group of conductors, insulated and twisted as described in connection with FIGS. 1 and 1A, is indicated by reference numeral 10 and is surrounded by protective banding 20, then by a metallic shielding 30, and finally by a protective sheath 40, all these elements being naturally concentric. FIG. 2 also shows an enlarged view of conductors 10 twisted in pairs, wherein each of the twisted pairs are twisted with a different pitch, the pitch of the twisted pairs differing with respect to one another in a geometrical progression. As described herein, the geometrical progression may have a rate between 1 and 2. In one aspect, the geometrical progression may have a rate between about 1.01 and about 1.09.

Figure 2A:
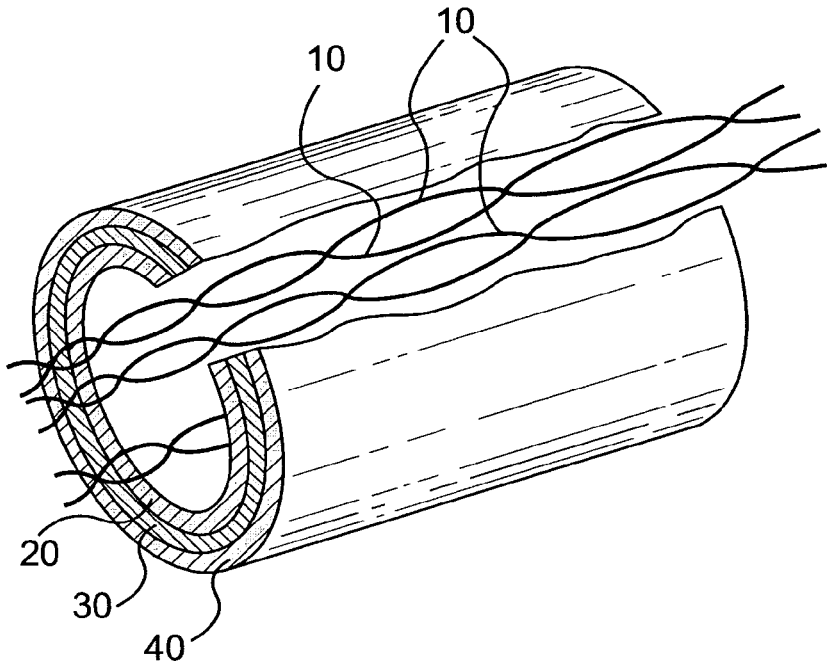
FIG. 2A shows a view of the cable depicted in FIG. 2 with a portion of the outer layers of the cable removed to illustrate conductors twisted in pairs with a series of pitches following a geometrical progression in accordance with the present invention.

FIG. 2A shows the cable depicted in FIG. 2 with a portion of the protective banding 20, the metallic shielding 30 and the protective sheath 40 removed to illustrate the conductors 10 twisted in pairs with a series of pitches following a geometrical progression. As described herein, the geometrical progression can have a rate between 1 and 2. More preferably, the geometrical progression can have a rate between about 1.01 and about 1.09.

FIGS. 3 to 6 present the results of tests, in a comparative manner, between a cable produced using the concepts of the prior art, that will be designated as the reference cable, and a cable produced in accordance with the present invention, that will henceforth be designated as the digital cable. The table II below reports the characteristics of the two cables.

TABLE II

Characteristics of cables used in the tests

| Parameter | Reference cable | Invention cable |
|---|---|---|
| Outer diameter conductive core (mm) | 0.393 | 0.393 |
| Type of insulation | Solid | Foam/skin |
| Outer diameter foam (mm) | — | 0.721 |
| Outer diameter skin (mm) | — | 0.801 |
| Outer diameter insulation (mm) | 0.701 | — |
| Thickness foam (mm) | — | 0.164 |
| Thickness skin (mm) | — | 0.04 |
| Thickness insulation(mm) | 0.154 | — |
| Minimum pitch(mm) | 51.9 | 26.9 |
| Maximum pitch(mm) | 138.1 | 71.5 |
| Geometricalprogression rate | — | 1.042 |

Figure 3:
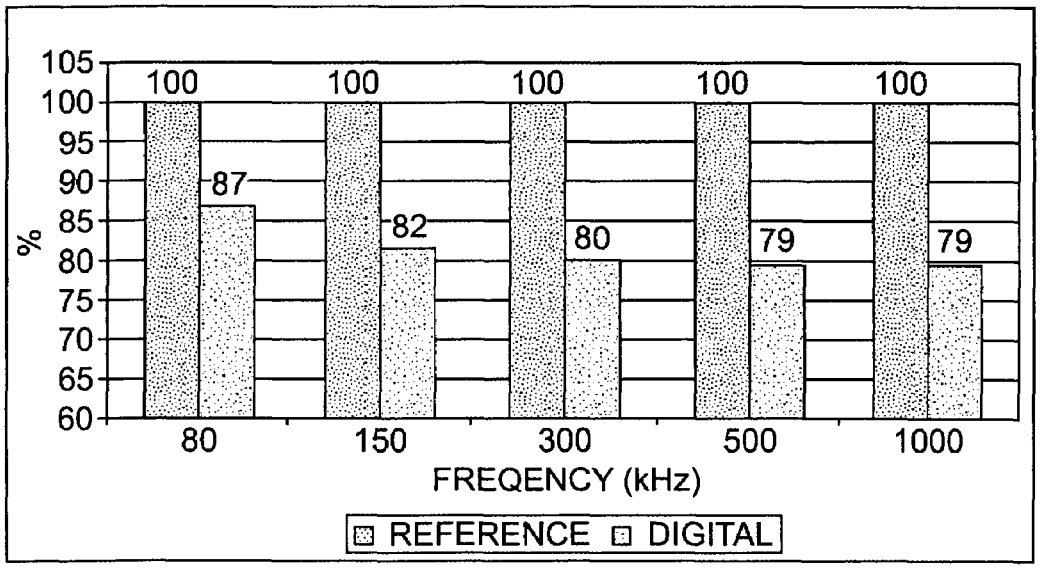
FIG. 3 is a chart illustration comparing the improvement in attenuation at 20° C. for a cable according to the invention as opposed to a reference cable not in accordance with the invention.

FIG. 3 shows the results of attenuation according to frequency at 20° C., where it is apparent that there is obtained a decrease attenuation of about 13% for a frequency of 80 kHz to about 21% for a frequency of 1000 kHz.

Figure 4:
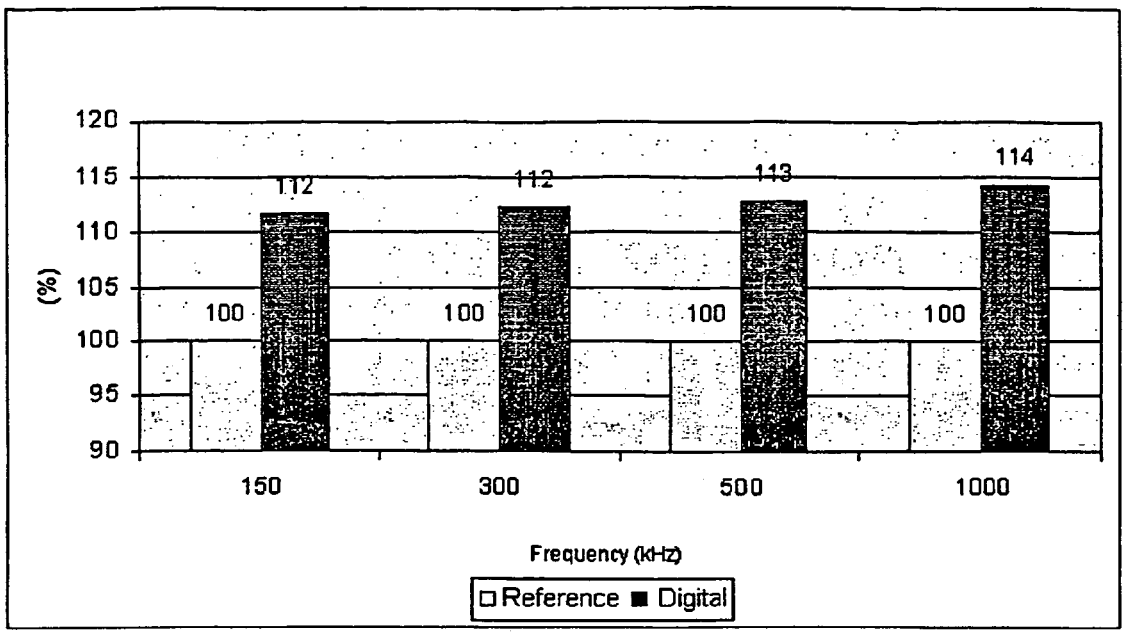
FIG. 4 is a chart illustration comparing the improvement in far end-cross talk according to frequency for a cable according to the invention as opposed to a reference cable not in accordance with the invention.
Figure 5:
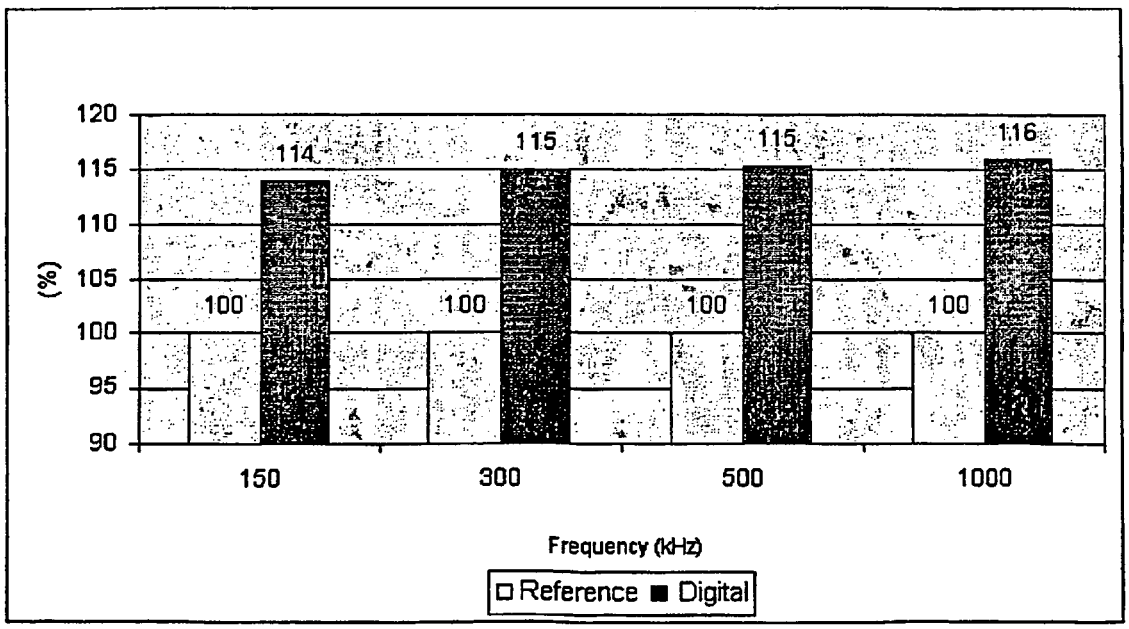
FIG. 5 is a chart illustration comparing the improvement in near end-cross talk according to frequency for a cable according to the invention as opposed to a reference cable not in accordance with the invention.

FIG. 4 depicts the results for far end-cross talk and FIG. 5 depicts the results for near end-cross talk. In both cases, for values of 100% of the reference cable, the values for far end-cross talk reach about 112-114% and the values for near end-cross talk reach 114-116%.

Figure 6:
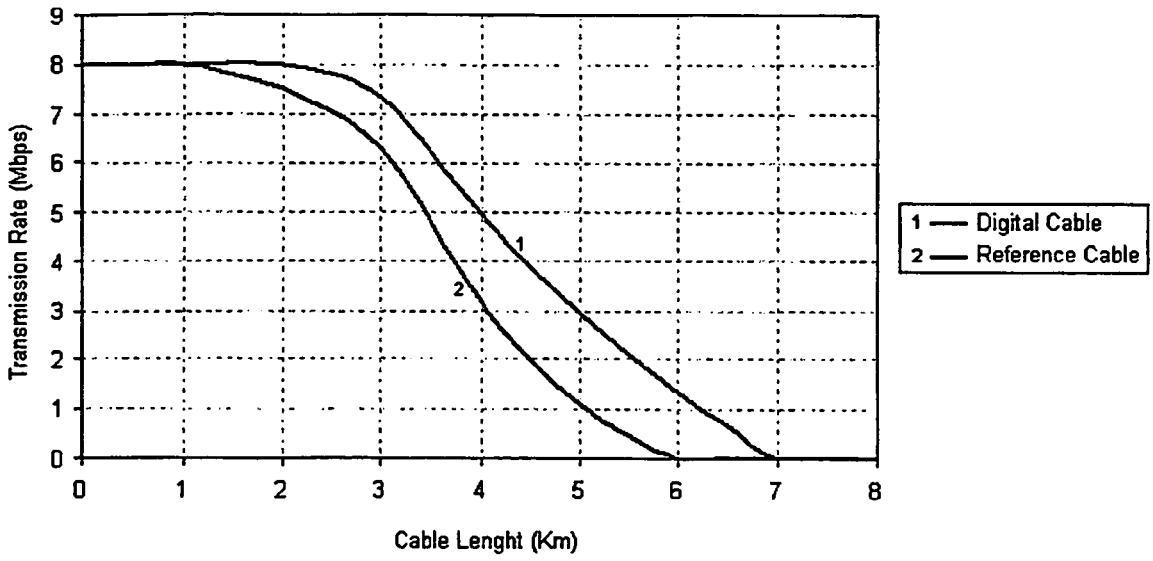
FIG. 6 is a chart illustration of a comparison of distance according to frequency.

FIG. 6 illustrates the increase in distance reached when carrying digital subscriber line system technology, comparing the reference cable to the digital cable. It can be noticed that for the same length of cable, there is obtained an increased transmission rate (Mbps) with the cable according to the present invention.

There should be noted that the absolute values shown in the comparative charts of FIGS. 3 to 6 are merely illustrative.

What is claimed is:

1. A twisted metallic conductor cable with high electrical performance for use in digital systems comprising at least three twisted pairs of insulated metallic conductors, wherein the insulation comprises a thermoplastic material, and at least a protective layer surrounding said at least three twisted pairs of insulated metal conductors, wherein the insulated metallic conductors forming each of the at least three twisted pairs are twisted with a predetermined pitch, wherein the predetermined pitches of the at least three twisted pairs of insulated metallic conductors are different with respect to one another, and wherein the different predetermined pitches either increase or decrease in a geometrical progression defined by the formula $a_n=a_1*g^{n-1}$, wherein a=pitch value, n=pair number, and q=ratio of geometrical progression.

2. The cable according to claim 1, wherein said pitches have a maximum and a minimum value between 10 and 110 mm.

3. The cable according to claim 1, wherein said maximum and minimum values are between 10 and 80 mm.

4. The cable according to claim 1, wherein the geometrical progression has a rate higher than 1 and lower than 2.

5. The cable according to claim 1, wherein the geometrical progression has a rate between about 1.01 and 1.09.

6. The cable according to claim 1, wherein the conductors are provided with corresponding insulations and the ratio between the diameter of the conductor and the thickness of the corresponding insulation is between 2.0 and 2.2.

7. The cable according to claim 6, wherein said insulation provides an equivalent dielectric constant between 1.7 and 2.

8. The cable according to claim 6, wherein said insulation is formed in two parts, of which one is an internal part made of a cellular thermoplastic material and the other part is an external part made of a rigid thermoplastic material.

9. The cable according to claim 8, wherein the cellular thermoplastic material is made of cellular polyethylene with 20% or 40% expansion rate.

10. The cable according to claim 8, wherein the rigid material is made of a material selected from solid high density, medium density or low density polyethylene, polypropylene or polyvinyl chloride (PVC).

11. The cable according to claim 1, wherein said protective layer comprises a protective banding, then a metallic shielding and then a protective sheath, all these elements being disposed concentrically.

* * * * *